United States Patent [19]

Wiley

[11] 4,400,603

[45] Aug. 23, 1983

[54] ELECTRICAL SWITCH FOR ALTERNATING CURRENT

[75] Inventor: Roy O. Wiley, Huntington, Conn.

[73] Assignee: Westinghouse Electric Corp., Pittsburgh, Pa.

[21] Appl. No.: 286,150

[22] Filed: Jul. 23, 1981

[51] Int. Cl.[3] ..... H01H 9/34; H01H 21/84

[52] U.S. Cl. ..... 200/153 G; 200/305

[58] Field of Search ..... 200/153 G, 153 H, 305, 200/304

[56] References Cited

U.S. PATENT DOCUMENTS

| | | | |
|---|---|---|---|
| 485,028 | 10/1892 | Binswanger | 200/153 G |
| 1,196,662 | 8/1916 | Chebrou et al. | 200/165 |
| 1,465,412 | 8/1923 | Bissell et al. | 200/76 |
| 1,717,057 | 6/1929 | Meuer | 200/165 |
| 2,133,545 | 10/1938 | Krieger | 200/163 |
| 2,150,013 | 3/1939 | Von Hoorn | 200/74 |
| 2,366,474 | 1/1945 | Bentley | 200/163 |
| 2,486,127 | 10/1949 | Davies | 200/148 C |
| 2,550,623 | 4/1951 | Teruzzi | 200/153 G |
| 2,578,494 | 12/1951 | Wiggins | 200/153 L |
| 2,783,317 | 2/1957 | Eckles | 200/153 G |
| 2,880,291 | 3/1959 | Bussmann | 200/154 |
| 3,137,780 | 6/1964 | Powell | 200/304 |
| 3,155,803 | 11/1964 | Klein et al. | 200/153 G |
| 3,402,273 | 9/1968 | Davis . | |
| 3,492,614 | 1/1970 | Angelo et al. | 200/153 G |
| 3,603,755 | 9/1971 | Ranzanigo | 200/153 G |
| 3,808,386 | 4/1974 | Strobel | 200/153 G |

FOREIGN PATENT DOCUMENTS

| | | | |
|---|---|---|---|
| 192996 | 11/1957 | Austria | 200/153 G |

*Primary Examiner*—John W. Shepperd

*Attorney, Agent, or Firm*—R. P. Lenart

[57] ABSTRACT

An electrical switch for use in alternating current circuits is constructed to provide slow contact separation and positive switch action. A pivotally mounted operating handle accepts a pivot pin at one end of a link member. A pivot pin at the other end of the link member fits into a brush lifter. Angular motion of the operating handle produces rectilinear motion in the brush lifter which results in opening and closing the switch contacts. A unique arc shield which encircles one out of each pair of contacts, protects the switch mechanism from destructive effects of contact arcing.

8 Claims, 9 Drawing Figures

ELECTRICAL SWITCH FOR ALTERNATING CURRENT

BACKGROUND OF THE INVENTION

1. Field of the Invention

This invention relates to electrical switches and particularly to switches for use in alternating current circuits.

2. Description of the Prior Art

Lever operated switches for use in electrical circuits are well known in the art. Such switches provide a convenient means for manually switching electrical current.

Numerous U.S. patents have been issued which disclose lever type switches wherein movement of the lever acts directly on a plunger or similar member which in turn acts upon the electrical contacts. These patents include: Chebrou and Lemp—U.S. Pat. No. 1,196,662; Bissell et al.—U.S. Pat. No. 1,465,412; Meuer—U.S. Pat. No. 1,717,057; Krieger—U.S. Pat. No. 2,133,545; Von Hoorn—U.S. Pat. No. 2,150,013; Bentley—U.S. Pat. No. 2,366,474; Wiggins—U.S. Pat. No. 2,578,494; and Bussman—U.S. Pat. No. 2,880,291.

In other instances, U.S. patents have issued for lever operated switch mechanisms wherein the lever acts upon a link which pivots in such a way so as to cause the closing or opening of the contacts. These patents include: Binswanger—U.S. Pat. No. 485,028; Teruzzi—U.S. Pat. No. 2,550,623; Ranzanigo—U.S. Pat. No. 3,603,755; and Strobel—U.S. Pat. No. 3,808,386.

Where high currents are being interrupted by switch contacts, an arc may be formed at the contact surfaces, resulting in the generation of heat and hot gases. It is desirable to shield the remainder of the switch structure from the potentially destructive effects which can result from arc generated heat and gases. Contact shielding has been used for this purpose, as shown in U.S. Pat. No. 2,486,127, issued to Davies.

The present invention seeks to improve the prior art by providing a relatively high current interrupting capability in a small package with a minimum number of parts. The parts can be easily assembled, thereby reducing the cost of the switch.

SUMMARY OF THE INVENTION

The present invention switch is operated by manually manipulating a pivotally mounted handle from the ON to the OFF position and vice versa. The action of the handle is transmitted to the contacts via a link and brush lifter which bears against a contact lever to open the contacts. Contact closure force is provided by a spring which tends to hold the contacts closed. This arrangement provides for an easily operated, low friction mechanism.

Indexing of the handle is provided by two springs. These springs apply a force to the brush lifter which is transmitted through the link to the handle. The link pivots at each end on two pins, one of which engages the handle while the other engages the brush lifter. When the handle is in the off position, the link is nearly straightened out between the handle and the brush lifter. In order to prevent an accidental switch closure due to shock or vibration of the operating mechanism, the handle is held in the OFF position by virtue of the fact that the slot in the handle which holds one of the link pivot pins is off center with respect to the center line of the handle.

When the handle is manipulated, the slot which holds one of the link pivot pins passes through an arc which provides a low friction method of changing the orientation of the link between the handle and the brush lifter. This arrangement minimizes the probability of the handle being stopped in an intermediate position between ON and OFF, thus assuring positive switch action.

When switching alternating current, a slow contact separation is desirable. This minimizes the energy dissipated in an arc at the contacts by limiting arc length until the alternating current is extinguished as it passes through a zero point. Since contact separation in the present invention is caused by manual force on the handle, which is opposed by two brush lifter springs and a contact closure spring, the resulting contact separation acceleration is minimized, reducing contact speed upon separation.

Even with a slow contact separation, arcing can occur when high currents are interrupted. A uniquely designed arc shield encircles one of the contacts in the present invention, to minimize destructive effects of contact arcing on surrounding structures.

Use of the several features of the invention in combination permits the manufacture of a highly reliable, yet economical, switch in a compact unit capable of relatively high ratings, such as 60 amperes at 600 volts, AC.

DESCRIPTION OF THE PREFERRED EMBODIMENT

Figure 1:
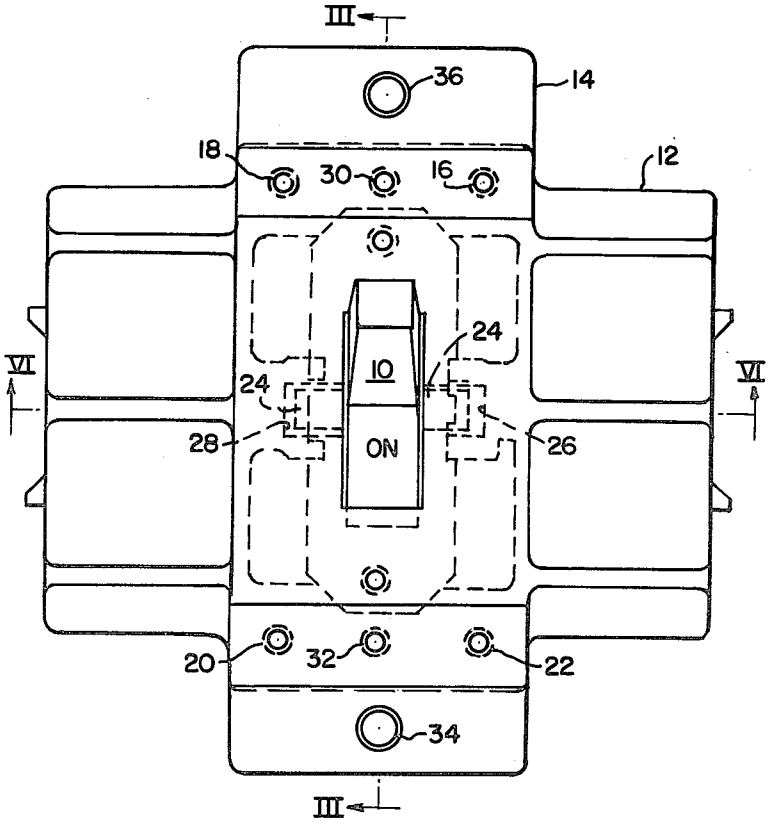
FIG. 1 is a plan view of an embodiment of the present invention switch.

Referring to the drawings, FIG. 1 shows a three-pole switch, which is representative of the present invention, with the operating handle 10 in the ON position. The switch enclosure 12, such as of molded insulating material, is large enough to contain three poles. However, it will be understood that the invention applies as well to switches of less or greater complexity which contain a different number of poles.

Faceplate 14, such as of metal, is mounted to enclosure 12 by four faceplate bolts 16, 18, 20 and 22. This serves to hold operating handle pivot pin 24 in slots 26 and 28 of enclosure 12. Mounting holes 30, 32, 34 and 36 are provided in face plate 14, for mounting the switch on a control panel.

Figure 2:
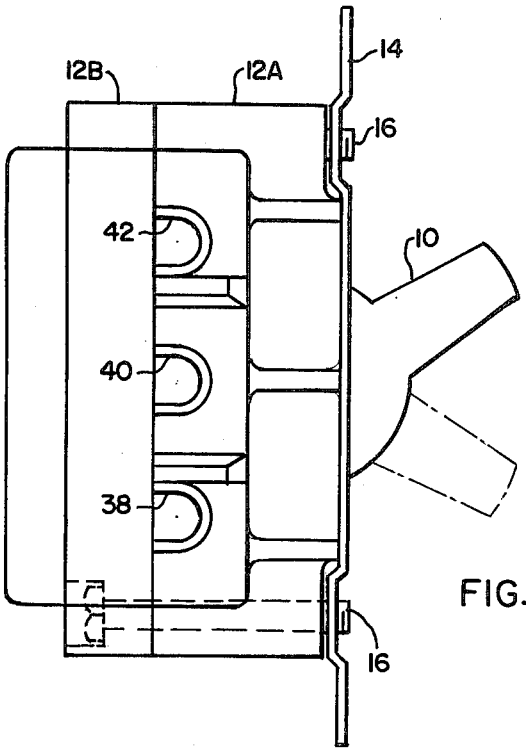
FIG. 2 is a side elevation of the switch of FIG. 1.

FIG. 2 is a side elevation view of the switch of FIG. 1, showing apertures 38, 40, and 42 through which conductors of a circuit controlled by the switch can be inserted. A like number of apertures is provided on the opposite side of the switch (not shown). Enclosure 12 is shown to consist of two components 12A and 12B. These enclosure components 12A and 12B and faceplate 14 are held together by faceplate bolts 16, 18, 20 and 22. Faceplate bolt 16 is shown to illustrate the method used to attach enclosure components 12A and 12B to faceplate 14.

Figure 3:
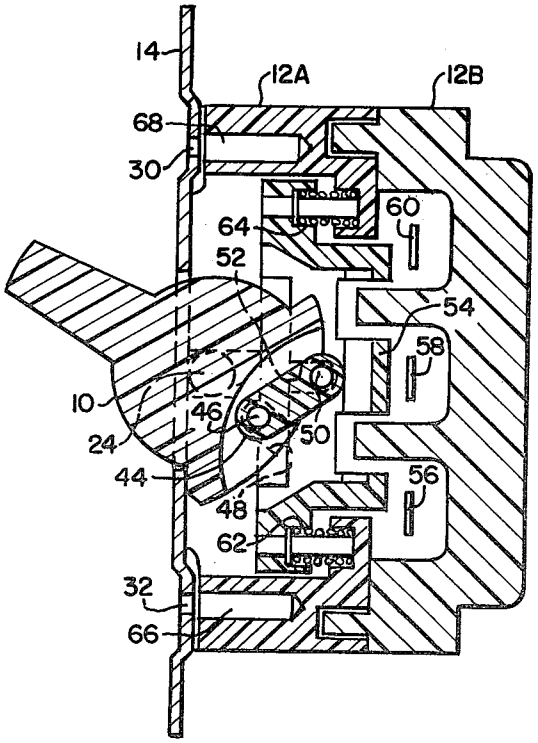
FIG. 3 is a longitudinal cross section of the switch of FIG. 1, taken through line III—III of FIG. 1.

FIG. 3 is a cross section view of the switch of FIG. 1, taken through line III—III in FIG. 1. Link 44 is shown with pin 46 located in U-shaped operating handle slot 48, and pin 50 located in U-shaped brush lifter slot 52. Operating handle 10 is shown in the ON position. When operating handle 10 pivots on pivot pin 24, link 44 tends to straighten out between operating handle 10 and brush lifter 54, thus forcing brush lifter 54 away from faceplate 14 and toward contact levers 56, 58 and 60. Brush lifter springs 62 and 64 provide means for exerting a force on brush lifter 54 which is directed toward faceplate 14 and tends to ensure positive operation of the operating handle. This feature is explained in greater detail in the description of FIG. 8. Slots 66 and 68 are provided in enclosure component 12A to accept mounting screws which pass through mounting screw holes 30 and 32 in faceplate 14.

Figure 4:
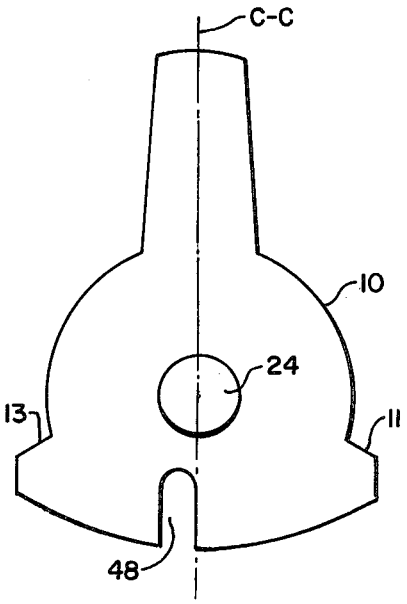
FIGS. 4 and 5 show an embodiment of the operating handle of the present invention.

FIG. 4 is a side view of operating handle 10, which shows how operating handle slot 48 is off center with respect to center line C—C. Operating handle stops 11 and 13 are also shown.

Figure 5:
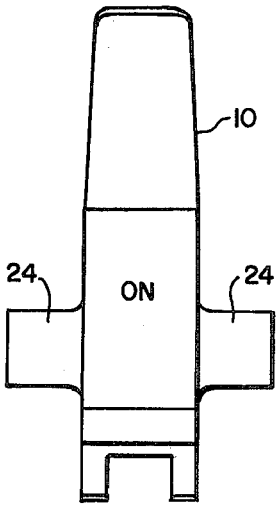

FIG. 5 is an end view of operating handle 10, showing how operating handle pivot pin 24 extends from both sides of the operating handle 10.

Figure 6:
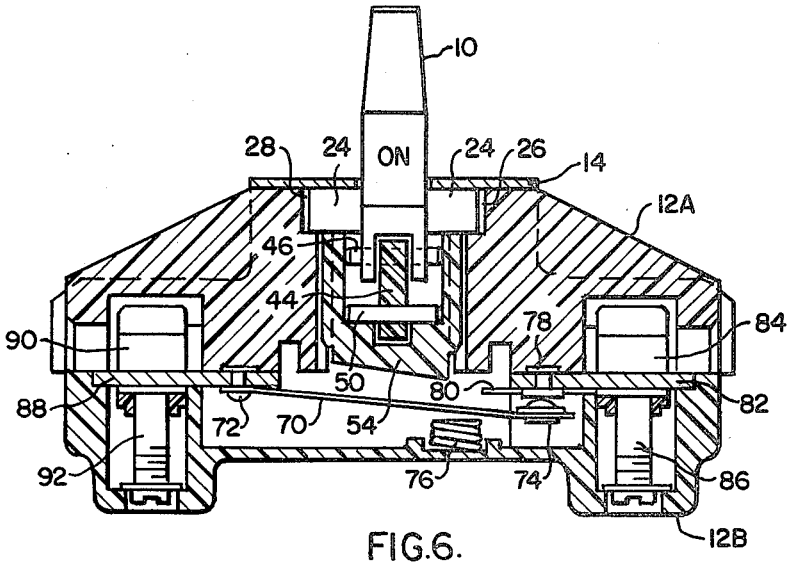
FIG. 6 is a longitudinal cross section of the switch of FIG. 1, taken through line VI—VI of FIG. 1.

FIG. 6 is a cross section view of the switch of FIG. 1, taken through line VI—VI in FIG. 1. Contact lever 70 is fixed at fulcrum 72 and carries movable contact 74 at the opposite end. Contact lever spring 76 exerts a force on contact lever 70 to maintain engagement between movable contact 74 and stationary contact 78. It should be apparent that contact lever 70 could be made of a spring material, thereby eliminating the need for contact lever spring 76. As operating handle 10 is moved from the ON position to the OFF position, link 44 pushes brush lifter 54 into contact lever 70, compressing contact lever spring 76 and separating movable contact 74 from stationary contact 78. Arc shield 80 which encircles stationary contact 78 protects structures adjacent to stationary contact 78 from the destructive effects of heat and gases produced by an arc between contacts 74 and 78. A conductor connection means consisting of bus bar 82, conductor clamp 84, and conductor clamp bolt 86 is attached to stationary contact 78. A similar conductor connection means consisting of bus bar 88, conductor clamp 90, and conductor clamp bolt 92 is attached to contact lever 70 at fulcrum 72. Note that all parts of both conductor connection means are recessed within enclosure 12 so that no electrically live parts are present on the external surfaces of the switch.

Figure 7:
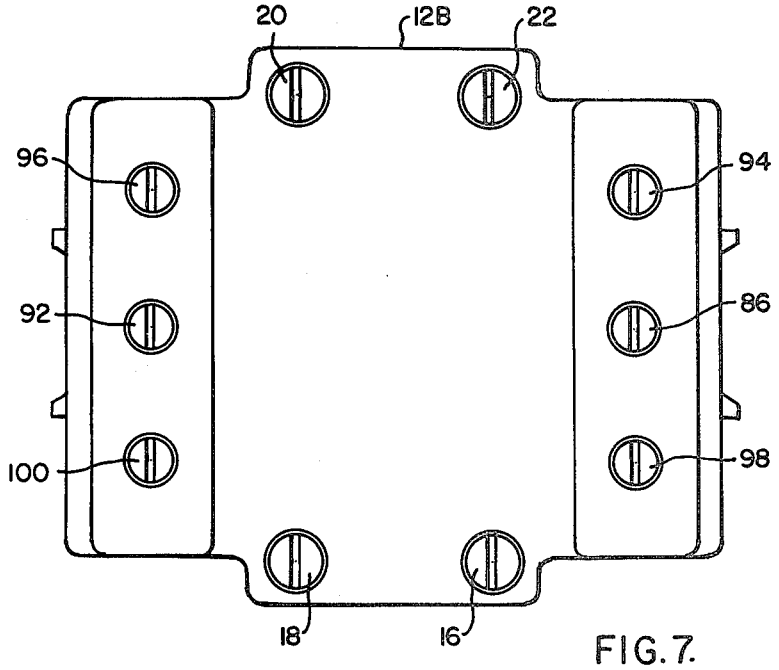
FIG. 7 is a plan view of the bottom of the switch of FIG. 1.

FIG. 7 is a plan view of the bottom of the switch of FIG. 1, showing faceplate bolts 16, 18, 20 and 22. Six conductor clamp bolts 86, 92, 94, 96, 98 and 100 are shown to accommodate the three poles of the switch shown in this embodiment.

Figure 8:
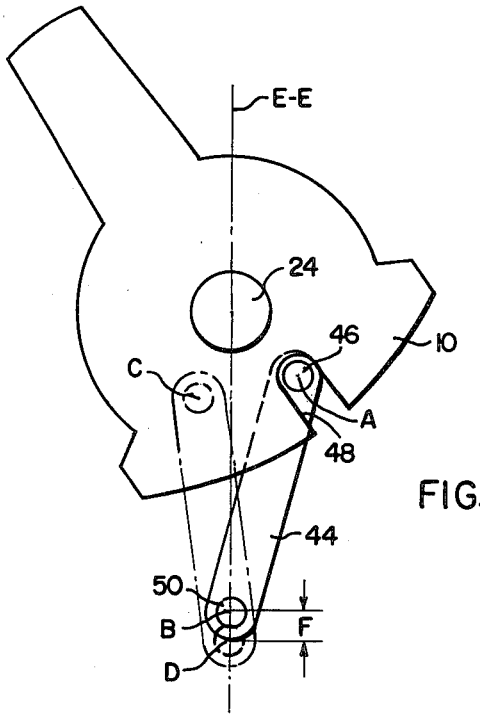
FIG. 8 schematically shows the function of a contact operating mechanism in accordance with the present invention.

FIG. 8 is a schematic representation which depicts the function of the operating handle 10 and link 44 which produces rectilinear movement of the brush lifter. When operating handle is in the ON position, slot 48 is positioned such that link pin 46 is in position A and link pin 50 is in position B. When the operating handle is switched to the OFF position, slot 48 is positioned such that link pin 46 is at position C and link pin 50 is at position D. This results in the rectilinear travel of link pin 50 from position B to position D, which is a distance F along center line E—E. Since link pin 50 is located in slot 52 of brush lifter 54, the brush lifter also will move a distance F.

FIG. 8 can also be used to illustrate the slow speed contact separation principle of this invention and the positive switch position feature. When operating handle 10 pivots around pivot pin 24, link pin 46 moves along an arc from position A to position C. This results in the movement of link pin 50 from position B to position D. It should be apparent that since the arc length from A to C is considerably larger than the distance F from B to D, and each link pin travels from its ON to OFF positions in the same amount of time; the velocity of link pin 50 will be smaller than the velocity of link pin 46. Therefore, the contact separation speed will be less than the operating handle speed. This ensures the desired slow separation of contacts which is beneficial when interrupting alternating currents.

The positive switch position feature of this invention is provided by the brush lifter springs that produce a force which is transmitted via link 44 to operating handle 10. It should be apparent to those skilled in the art that when operating handle 10 pivots to the point where link 44 is in line with center line E—E, the mechanism is in an unstable state. That is, the slightest movement of operating handle slot 48 to the right or left in FIG. 8 will result in the operating handle 10 being driven to pivot around its pivot pin 24 until one of the operating handle stops 11 or 13 contacts faceplate 14. This ensures that operating handle 10 can only stop in the full ON or full OFF position.

Figure 9:
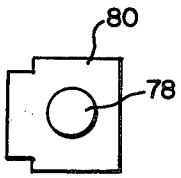
FIG. 9 shows an embodiment of the unique arc shield structure in accordance with the present invention.

FIG. 9 shows the placement of insulating arc shield 80 around stationary contact 78. By completely encircling stationary contact 78, the arc shield 80 provides maximum protection for structures in the vicinity of stationary contact 78. In this embodiment, arc shield 80 is held in place by virtue of the fact that the edge of the arc shield fits in a gap between enclosure component 12B and bus bar 82, as shown in FIG. 6.

There has been presented a simple embodiment of this invention which utilizes a small number of parts, thus facilitating assembly. However, it should be apparent to those skilled in the art that the invention may be practiced in forms additional to those specifically described and illustrated herein. For example, link 44 and link pins 46 and 50 could be molded as a single piece and the link pins could pass through holes in operating handle 10 and brush lifter 54, rather than resting in slots as shown in the preferred embodiment.

What is claimed is:

1. An electric switch comprising:

a stationary contact;

means for connecting said stationary contact to a conductor;

a contact lever, carrying at one end a contact movable into and out of engagement with said stationary contact;

means for connecting said contact lever to a conductor;

a fixed fulcrum to which the opposite end of said contact lever is attached;

a rectilinearly movable brush lifter with a U-shaped slot in the center of the brush lifter;

a brush lifter spring located at each of the ends of said brush lifter, which place a force on said brush lifter in a direction away from said contact lever;

a pivotally mounted operating handle with a U-shaped slot in one end which is off center with respect to the center line of the handle;

a link with an aperture near each end;

two pins, each passing through one of said link apertures where one of said pins is located in said brush lifter U-shaped slot and the second pin is located in said operating handle U-shaped slot;

said operating handle U-shaped slot being closer to said contact lever when said operating handle is in the OFF position rather than in the ON position, to force said brush lifter into said contact lever so that said movable contact separates from said stationary contact; and a contact spring engaging said contact lever between the ends and on the opposite side as said brush lifter, which exerts a force on said contact lever holding said stationary contact and said movable contact in engagement.

2. An electric switch as recited in claim 1, further comprising:

an enclosure with apertures containing said first and second means for connection to a conductor wherein all electrically live parts are recessed below the external surface of said enclosure.

3. An electric switch as recited in claim 1, wherein said operating handle is provided with stops such that the stops limit the pivot angle of said operating handle in the ON and OFF positions.

4. An electric switch as recited in claim 1, further comprising:

an insulating arc shield with an aperture which contains said stationary contact.

5. An electric switch comprising:

a plurality of stationary contacts;

means for connecting each of said stationary contacts to a conductor;

a plurality of contact levers, each carrying at one end a contact movable into and out of engagement with one of said stationary contacts;

means for connecting each of said contact levers to a conductor;

a plurality of fixed fulcrums to which the opposite end of each of said contact levers is attached;

a rectilinearly movable brush lifter with a U-shaped slot in the center of the brush lifter;

a brush lifter spring located at each of the ends of said brush lifter, which place a force on said brush lifter in a direction away from said contact levers;

a pivotally mounted operating handle with a U-shaped slot in one end which is off center with respect to the center line of the handle;

a link with an aperture near each end;

two pins, each passing through one of said link apertures where one of said pins is located in said brush lifter U-shaped slot and the second pin is located in said operating handle U-shaped slot;

said operating handle U-shaped slot being closer to said contact lever when said operating handle is in the OFF position rather than in the ON position, to force said brush lifter into said contact levers so that said movable contacts separate from said stationary contacts; and a plurality of contact lever springs engaging said contact levers between the ends and on the opposite side as said brush lifter, which exert a force on said contact levers holding said stationary contacts and said movable contacts in engagement.

6. An electric switch as recited in claim 5, further comprising:

an enclosure with apertures containing said means for connecting said stationary contacts and said contact levers to conductors wherein all electrically live parts are recessed below the external surface of said enclosure.

7. An electric switch as recited in claim 5, wherein said operating handle is provided with stops such that the stops limit the pivot angle of said operating handle in the ON and OFF positions.

8. An electric switch as recited in claim 5, further comprising:

a plurality of insulating arc shields, each with an aperture which contains one of said stationary contacts.

* * * * *